US009991627B1

(12) United States Patent
Hemme

(10) Patent No.: US 9,991,627 B1
(45) Date of Patent: Jun. 5, 2018

(54) POWER CORD LOCKING SYSTEM HAVING A LOCKING UNIT COUPLED TO A WALL AND HAVING AN U-SHAPED CHANNEL FOR POSITIONING THE POWER CORD

(71) Applicant: Benjamin Hemme, Concordia, MO (US)

(72) Inventor: Benjamin Hemme, Concordia, MO (US)

( * ) Notice: Subject to any disclaimer, the term of this patent is extended or adjusted under 35 U.S.C. 154(b) by 0 days. days.

(21) Appl. No.: 15/597,219

(22) Filed: May 17, 2017

(51) Int. Cl.
*H01R 13/62* (2006.01)
*H01R 13/58* (2006.01)
*H01R 13/639* (2006.01)

(52) U.S. Cl.
CPC ..... *H01R 13/5804* (2013.01); *H01R 13/58* (2013.01); *H01R 13/5833* (2013.01); *H01R 13/6395* (2013.01)

(58) Field of Classification Search
CPC H01R 13/58; H01R 13/5804; H01R 13/5833; H01R 13/62; H01R 13/639; H01R 13/6392; H01R 13/6395; H01R 13/64; H01R 13/72
USPC ..... 439/144, 145, 369, 373, 451, 501; 174/53, 66, 67, 135, 481
See application file for complete search history.

(56) References Cited

U.S. PATENT DOCUMENTS 1,979,756 A * 11/1934 McNamee ..... H01R 13/6395 174/135
2,943,138 A * 6/1960 Reager ..... H01R 13/72 174/481
D275,175 S 8/1984 Rolli, Jr.
4,702,709 A 10/1987 Santilli
5,549,482 A 8/1996 Langlais et al.
6,071,142 A * 6/2000 Blackman ..... H01R 13/6395 439/373
7,207,826 B1 * 4/2007 Yang ..... H01R 13/6395 439/371
7,230,181 B2 * 6/2007 Simmons ..... B65H 75/36 174/138 G
7,255,588 B2 8/2007 Wilder
7,638,710 B1 * 12/2009 Vance ..... H01R 13/6395 174/135
2011/0237114 A1 9/2011 Beene et al.
2012/0225578 A1 * 9/2012 Adams ..... H01R 13/6392 439/373
2014/0357112 A1 * 12/2014 Ma ..... H01R 13/6392 439/347
2015/0111411 A1 * 4/2015 Berry, III ..... H01R 24/76 439/362

FOREIGN PATENT DOCUMENTS

WO WO0103248 1/2001

* cited by examiner

*Primary Examiner* — Chandrika Prasad

(57) ABSTRACT

A includes an electrical outlet that is positioned on a wall. The electrical outlet has at least one female socket. A power cord is provided that has a male plug. The male plug is selectively electrically coupled to the at least one female socket. A locking unit provided. The locking unit is coupled to the wall and the locking unit is selectively manipulated. The locking unit selectively engages the power cord when the male plug is electrically coupled to the at least one female socket. Thus, the locking unit inhibits the male plug from falling out of the at least one female socket.

8 Claims, 3 Drawing Sheets

POWER CORD LOCKING SYSTEM HAVING A LOCKING UNIT COUPLED TO A WALL AND HAVING AN U-SHAPED CHANNEL FOR POSITIONING THE POWER CORD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to locking devices and more particularly pertains to a new locking device for retaining an extension cord in an outlet.

BRIEF SUMMARY OF THE INVENTION

An embodiment of the disclosure meets the needs presented above by generally comprising an electrical outlet that is positioned on a wall. The electrical outlet has at least one female socket. A power cord is provided that has a male plug. The male plug is selectively electrically coupled to the at least one female socket. A locking unit provided. The locking unit is coupled to the wall and the locking unit is selectively manipulated. The locking unit selectively engages the power cord when the male plug is electrically coupled to the at least one female socket. Thus, the locking unit inhibits the male plug from falling out of the at least one female socket.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
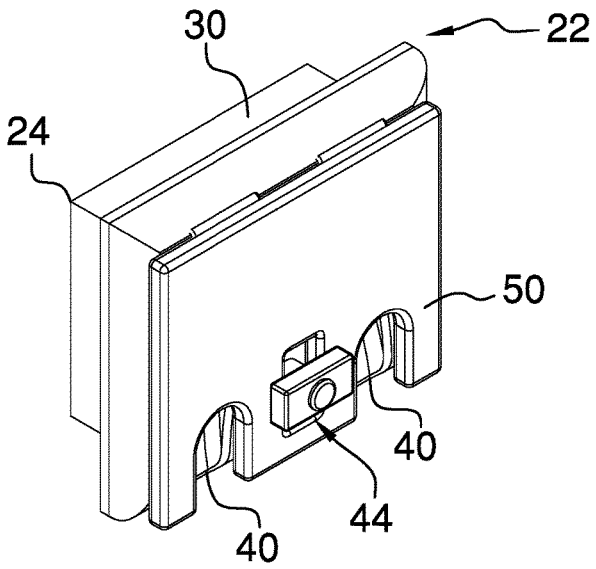
FIG. 1 is a front perspective view of a locking unit of a power cord locking system according to an embodiment of the disclosure.
Figure 2:
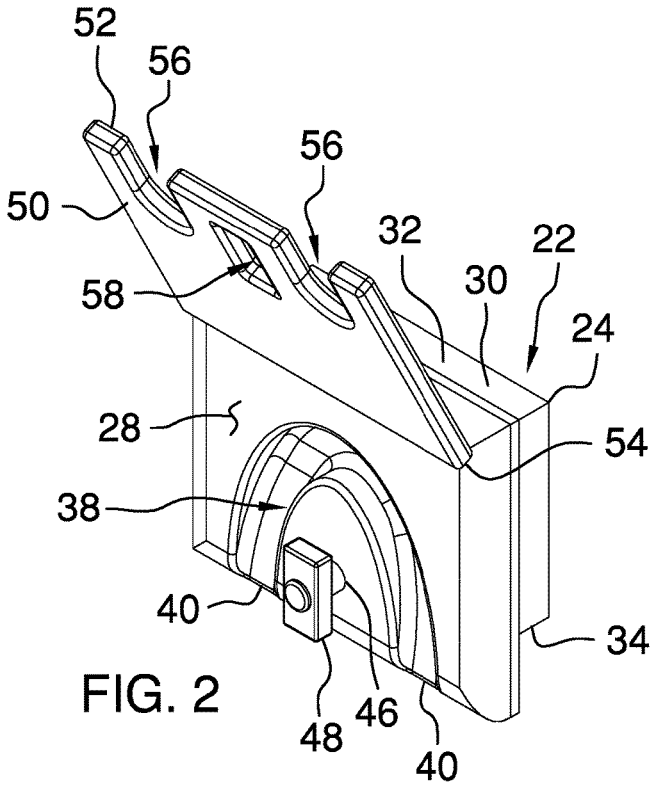
FIG. 2 is a perspective view of a locking unit of an embodiment of the disclosure in an open position.
Figure 3:
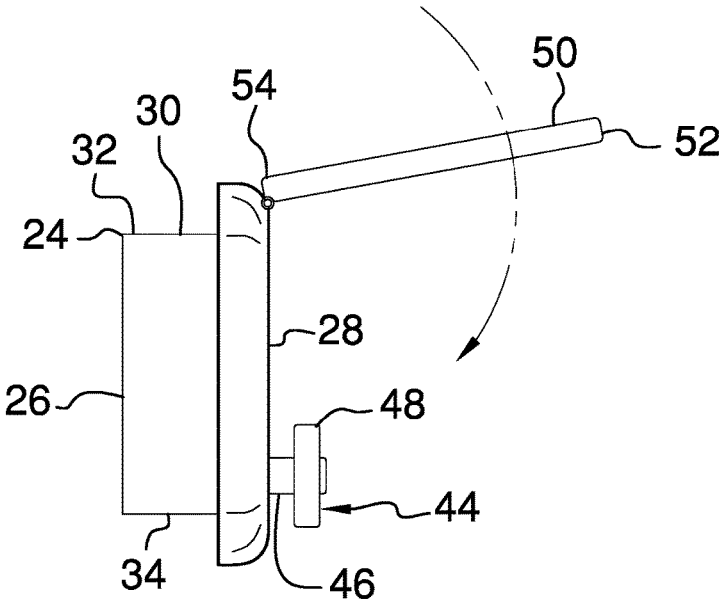
FIG. 3 is a right side view of a locking unit of an embodiment of the disclosure.
Figure 4:
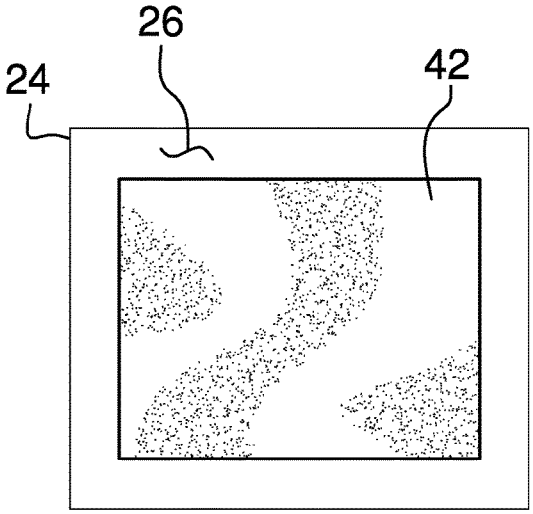
FIG. 4 is a back view of a locking unit of an embodiment of the disclosure.
Figure 5:
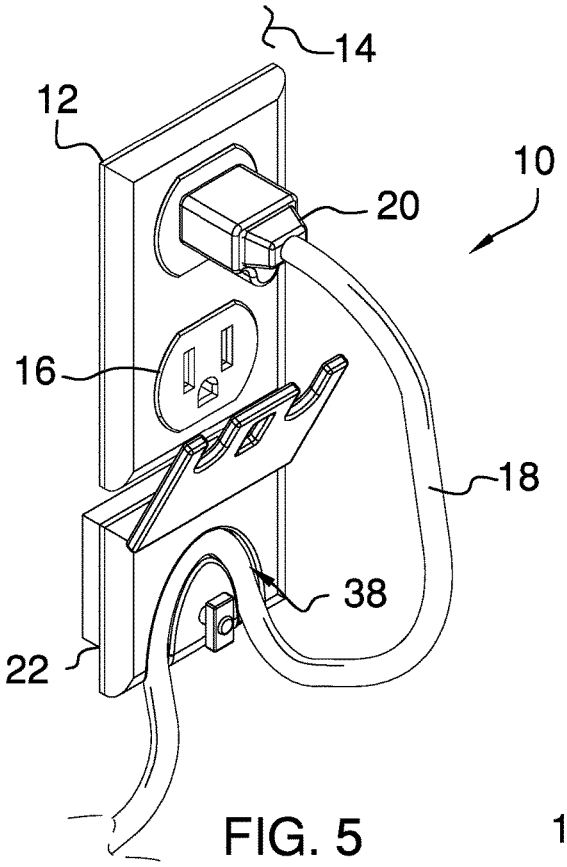
FIG. 5 is a perspective in-use view of an embodiment of the disclosure showing a lid in an open position.
Figure 6:
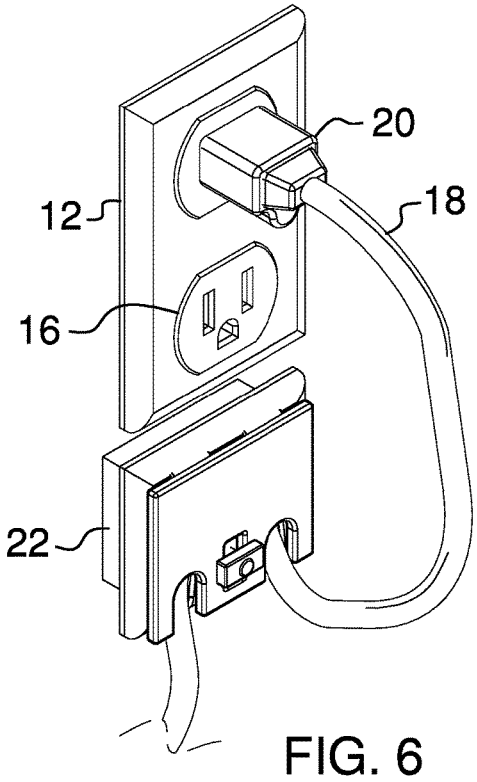
FIG. 6 is a perspective in-use view of an embodiment of the disclosure showing a lid in a closed position.

With reference now to the drawings, and in particular to FIGS. 1 through 6 thereof, a new locking device embodying the principles and concepts of an embodiment of the disclosure and generally designated by the reference numeral 10 will be described.

As best illustrated in FIGS. 1 through 6, the power cord locking system 10 generally comprises an electrical outlet 12 that is positioned on a wall 14. The electrical outlet 12 has at least one female socket 16. The wall 14 may be a wall 14 in a building or the like. The electrical outlet 12 may be electrically coupled to an electrical distribution system 46.

A power cord 18 is provided that has a male plug 20. The male plug 20 is selectively electrically coupled to the at least one female socket 16. Thus, the power cord 18 is electrically coupled to a power source. The power cord 18 may be an extension cord or the like and the power cord 18 may supply electrical current to a power tool or the like.

A locking unit 22 is coupled to the wall 14 and the locking unit 22 may be manipulated. The locking unit 22 selectively engages the power cord 18 when the male plug 20 is electrically coupled to the at least one female socket 16. Thus, the locking unit 22 inhibits the male plug 20 from falling out of the at least one female socket 16. The locking unit 22 facilitates uninterrupted electrical current to the power tool.

The locking unit 22 comprises a panel 24. The panel 24 has a first surface 26, a second surface 28 and a peripheral edge 30 extending therebetween. The peripheral edge 30 has a top side 32 and a bottom side 34. A lip 36 may extend outwardly from the peripheral edge 30 and the lip 36 may be coextensive with the peripheral edge 30. The lip 36 may be aligned with said second surface 28.

The second surface 28 has a channel 38 extending toward the first surface 26. The channel 38 has a pair of terminal ends 40. Moreover, each of the terminal ends 40 intersects the bottom side 34. The channel 38 is arcuate between the terminal ends 40 such that the channel 38 forms a U-shape.

The power cord 18 is positioned in the channel 38 having the power cord 18 extending outwardly from each of the terminal ends 40.

An adhesive layer 42 is coupled to the first surface 26. The adhesive layer 42 adhesively engages the wall 14. Thus, the panel 24 is retained on the wall 14. The panel 24 is positioned beneath the electrical outlet 12. The power cord 18 is positioned in the channel 38 to form a loop extending between the electrical outlet 12 and the locking unit 22.

A latch 44 is provided. The latch 44 is rotatably coupled to the panel 24 and the latch 44 may be manipulated. The latch 44 has a stem 46 and a head 48. The stem 46 is positioned on the second surface 28 and the head 48 is spaced from the second surface 28. The head 48 is selectively rotated about a longitudinal axis extending through the stem 46. Moreover, the stem 46 is positioned between the terminal ends 40 of the channel 38.

A lid 50 is provided that has a top edge 52 and a bottom edge 54. The top edge 52 is hingedly coupled to the top side 32 of the panel 24. The lid 50 is selectively positioned in a closed position having the lid 50 abutting the second surface 28 of the panel 24. The bottom edge 54 has a pair of slots 56. Each of the slots 56 extends toward the top edge 52. Moreover, each of the slots 56 is aligned with an associated one of the terminal ends 40 of the channel 38 when the lid 50 in the closed position.

The lid 50 retains the power cord 18 in the channel 38 when the lid 50 is positioned in the closed position. Thus, the locking unit 22 inhibits the male plug 20 from supporting a weight of the power cord 18. The lid 50 has an aperture 58 extending therethrough. The aperture 58 is aligned with the latch 44 when the lid 50 is positioned in the closed position. The head 48 passes through the aperture 58 when the head 48 is rotated into a first position. Moreover, the head 48 abuts the lid 50 when the head 48 is rotated into a second position. Thus, the head 48 inhibits the lid 50 from being opened.

In use, the panel 24 is positioned on the wall 14 beneath the electrical outlet 12. The power cord 18 is positioned in the channel 38 to define a pig tail between the panel 24 and the male plug 20 on the power cord 18. The lid 50 is positioned in the closed position and the latch 44 is manipulated to retain the lid 50 in the closed position. The male plug 20 is selectively plugged into the at least one female socket 16. The locking unit 22 inhibits the male plug 20 from falling out of the at least one female socket 16.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A power cord locking system comprising:

an electrical outlet being positioned on a wall, said electrical outlet having at least one female socket;

a power cord having a male plug, said male plug being selectively electrically coupled to said at least one female socket wherein said power cord is configured to be electrically coupled to a power source; and a locking unit being coupled to said wall wherein said locking unit is configured to be manipulated, said locking unit selectively engaging said power cord when said male plug is electrically coupled to said at least one female socket, said locking unit inhibiting said male plug from falling out of said at least one female socket, wherein said locking unit comprises a panel having a first surface, a second surface and a peripheral edge extending there-between, said peripheral edge having a top side and a bottom side, and wherein said second surface has a channel extending toward the first surface, said channel having a pair of terminal ends, each of said terminal ends intersecting said bottom side, said channel being arcuate between said terminal ends such that said channel forms a U-shape, said power cord being positioned in said channel having said power cord extending outwardly from each of said terminal ends.

2. The system according to claim 1, further comprising an adhesive layer being coupled to said first surface, said adhesive layer adhesively engaging said wall such that said panel is retained on said wall, said panel being positioned beneath said electrical outlet.

3. The system according to claim 1, further comprising a latch being rotatably coupled to said panel wherein said latch is configured to be manipulated.

4. The system according to claim 3, wherein:

said latch has a stem and a head, said stem being positioned on said second surface having said head being spaced from said second surface, said head being selectively rotated about a longitudinal axis extending through said stem, said stem being positioned between said terminal ends of said channel.

5. The system according to claim 1, further comprising a lid having a top edge and a bottom edge, said top edge being hingedly coupled to said top side of said panel.

6. The system according to claim 3, wherein:

said bottom edge has a pair of slots, each of said slots extending toward said top edge, each of said slots being aligned with an associated one of said terminal ends of said channel when said lid in a closed position having said lid abutting said second surface, said lid retaining said power cord in said channel when said lid is positioned in said closed position such that said locking unit inhibits said male plug from supporting a weight of said power cord.

7. The system according to claim 3, wherein:

said panel includes a latch, said latch having a head; and said lid has an aperture extending therethrough, said aperture being aligned with said latch when said lid is positioned in said closed position, said head passing through said aperture when said head is rotated into a first position, said head abutting said lid when said head is rotated into a second position such that said head inhibits said lid from being opened.

8. A power cord locking system comprising:

an electrical outlet being positioned on a wall, said electrical outlet having at least one female socket;

a power cord having a male plug, said male plug being selectively electrically coupled to said at least one female socket wherein said power cord is configured to be electrically coupled to a power source; and a locking unit being coupled to said wall wherein said locking unit is configured to be manipulated, said locking unit selectively engaging said power cord when said male plug is electrically coupled to said at least one female socket, said locking unit inhibiting said male plug from falling out of said at least one female socket, said locking unit comprising:

a panel having a first surface, a second surface and a peripheral edge extending therebetween, said peripheral edge having a top side and a bottom side, said second surface having a channel extending toward said first surface, said channel having a pair of terminal ends, each of said terminal ends intersecting said bottom side, said channel being arcuate between said terminal ends such that said channel forms a U-shape, said power cord being positioned in said channel having said power cord extending outwardly from each of said terminal ends, an adhesive layer being coupled to said first surface, said adhesive layer adhesively engaging said wall such that said panel is retained on said wall, said panel being positioned beneath said electrical outlet, a latch being rotatably coupled to said panel wherein said latch is configured to be manipulated, said latch having a stem and a head, said stem being positioned on said second surface having said head being spaced from said second surface, said head being selectively rotated about a longitudinal axis extending through said stem, said stem being positioned between said terminal ends of said channel, and a lid having a top edge and a bottom edge, said top edge being hingedly coupled to said top side of said panel, said bottom edge having a pair of slots, each of said slots extending toward said top edge, each of said slots being aligned with an associated one of said terminal ends of said channel when said lid in a closed position having said lid abutting said second surface, said lid retaining said power cord in said channel when said lid is positioned in said closed position such that said locking unit inhibits said male plug from supporting a weight of said power cord, said lid having an aperture extending therethrough, said aperture being aligned with said latch when said lid is positioned in said closed position, said head passing through said aperture when said head is rotated into a first position, said head abutting said lid when said head is rotated into a second position such that said head inhibits said lid from being opened.

* * * * *